US012607114B2

(12) United States Patent
Stevens et al.

(10) Patent No.: US 12,607,114 B2
(45) Date of Patent: Apr. 21, 2026

(54) DRILLING APPARATUS AND METHOD FOR THE DETERMINATION OF FORMATION LOCATION

(71) Applicant: ANTECH LIMITED, Exeter (GB)

(72) Inventors: Richard Stevens, Devon (GB); Antoni Miszewski, Devon (GB)

(73) Assignee: Antech Limited, Exeter (GB)

( * ) Notice: Subject to any disclaimer, the term of this patent is extended or adjusted under 35 U.S.C. 154(b) by 111 days.

(21) Appl. No.: 16/765,998

(22) PCT Filed: Jan. 25, 2019

(86) PCT No.: PCT/EP2019/025026
§ 371 (c)(1),
(2) Date: May 21, 2020

(87) PCT Pub. No.: WO2019/145122
PCT Pub. Date: Aug. 1, 2019

(65) Prior Publication Data

US 2020/0277823 A1 Sep. 3, 2020

(30) Foreign Application Priority Data

Jan. 26, 2018 (GB) ..... 1801354

(51) Int. Cl.
*E21B 47/026* (2006.01)
*E21B 7/04* (2006.01)
(Continued)

(52) U.S. Cl.
CPC ..... *E21B 47/026* (2013.01); *E21B 7/04* (2013.01); *E21B 44/00* (2013.01); *E21B 49/003* (2013.01)

(58) Field of Classification Search
CPC ..... E21B 7/06; E21B 45/00; E21B 47/024; E21B 47/12; E21B 49/003; E21B 44/005
See application file for complete search history.

(56) References Cited

U.S. PATENT DOCUMENTS 6,695,058 B1 * 2/2004 French ..... E21B 21/002 166/173
2002/0198661 A1 12/2002 Strickland
(Continued)

FOREIGN PATENT DOCUMENTS

EP 0351902 A1 1/1990
WO 2018212781 A1 11/2018

OTHER PUBLICATIONS

International Search Report and Written Opinion for PCT/EP2019/025026 dated Jul. 2, 2019, 13 pages.

*Primary Examiner* — Dany E Akakpo
(74) *Attorney, Agent, or Firm* — Lippes Mathias LLP

(57) ABSTRACT

An apparatus for drilling a well which includes a drill bit (2) arranged at the end of a length of drill tubing (4), a motor (3) to rotate the drill bit and steering means to steer the drill bit, and including torque measuring means (5) to measure the torque applied to the drill bit continuously and processing means to calculate values for the mechanical specific energy (MSB) and measured depth data over time whilst drilling. The processing means includes comparison means which is configured to compare the measured data with known data to determine the nature of the formation (6) being drilled compared to known types of formation, and which processing means is configured to indicate a change from a first formation type to a second formation type, thus indicating the presence of a formation boundary, when the drill bit is adjacent to or just past the formation boundary (7).

12 Claims, 6 Drawing Sheets

(51) Int. Cl.
*E21B 44/00* (2006.01)
*E21B 49/00* (2006.01)

(56) References Cited

U.S. PATENT DOCUMENTS

| | | | | |
|---|---|---|---|---|
| 2013/0049982 | A1* | 2/2013 | Hartmann | E21B 47/04 340/854.1 |
| 2013/0284434 | A1* | 10/2013 | Marvel | E21B 47/04 166/255.1 |
| 2014/0190747 | A1* | 7/2014 | Hay | G01G 23/01 73/1.13 |
| 2016/0017696 | A1 | 1/2016 | Srinivasan et al. | |
| 2016/0053543 | A1* | 2/2016 | Diaz | E21B 7/062 175/74 |
| 2016/0076357 | A1* | 3/2016 | Hbaieb | E21B 44/00 702/9 |
| 2017/0009529 | A1* | 1/2017 | Oluwafemi | E21B 17/20 |
| 2017/0089141 | A1* | 3/2017 | Haci | E21B 17/20 |
| 2017/0306754 | A1* | 10/2017 | Golparian | H04J 14/02 |

* cited by examiner

DRILLING APPARATUS AND METHOD FOR THE DETERMINATION OF FORMATION LOCATION

This invention relates to apparatus and method for the determination of the accurate formation location and its physical properties whilst drilling.

In particular this invention relates to the real time indication of rock porosity whilst a hole is being drilled in a geological formation.

The precise depths and thicknesses of geological formations vary spatially over an oilfield. When an oil well is being drilled, the driller directs the drill towards a target defined as a point in a 3 dimensional (3D) cartesian coordinate system. An individual borehole may be planned to pass through a number of such points sequentially. These points will have been chosen by a geologist to define the optimum location for the wellbore according to his/er best interpretation of the information available to him/er at the time of planning the wellbore.

Information about depths and thickness of geological formations is in large part based on interpolation between observed depths and thicknesses in adjacent wellbores. Because formation depths and thickness can vary non-linearly between wellbores, the difference between the geologist's predicted formation top, and that encountered in practice can be tens of feet. This can be sufficient to make a difference between being in the desired oil in the formation, or in the water below the oil, or in the impermeable seal above the oil, the latter two cases being non-profitable outcomes.

It is therefore problematic to direct the drilling of a well purely based on depth.

It is known to use sensors which are sensitive to distinguishing characteristics of the geological formation in the drill string, so that the presence of the target formation at the target depth can be confirmed based on the types of material usually found in the target formation. Gamma ray, resistivity, porosity and density are examples of these sensors.

Although sensors like these are highly developed and can provide a high degree of discrimination between neighbouring geological formations, they suffer from certain drawbacks.

One of these drawbacks is that the sensors are often, by necessity, many tens of feet behind the drill bit. A consequence of this is that thinner formations may be penetrated and exited by the bit before they are detectable by the sensor. This has the problem of drilling of unwanted material, which is usually more wearing on the drill bits, so is a waste of drill bit longevity and wastes energy.

Another drawback is that the sensor array may occupy many feet of bottom hole assembly (BHA). Not only does this create a longer BHA, which has practical disadvantages, but it reduces the resolution of the sensor along the wellbore. The result of this is that thin formations (formations whose thickness is less than the length of the sensor array) may be only partially visible to the sensor or not visible at all.

It is therefore an object of the present invention to provide a method of directional drilling and apparatus thereof which improves the location accuracy downhole and in particular to more accurately locate formation boundaries whilst drilling.

According to the present invention, there is provided a method of drilling a well which uses a drill bit driven by a rotating means and arranged at the end of a length of drilling tubing, and steering means to change the direction of drilling of the drill bit, comprising the following method steps:

a) measurements are made of the torque applied to the drill bit by the rotating means continuously,
b) values for the mechanical specific energy (MSE) are calculated during drilling,
c) measuring depth data over time whilst drilling,
d) comparison of the logged real time data with known values derived from historical formation data,
e) determining the type of the formation being drilled compared to known types of formation,
f) recording a change from a first formation type to a second formation type, thus indicating the presence of a formation boundary,
g) determining the accurate depth of the formation boundary, at the moment in time when the drill be is at or just past the formation boundary.

The invention utilises the real time measurement of parameters that results in the determination of an accurate value for the known measurement Mechanical Specific Energy (MSE) while drilling progresses. This is then usable in a way which is useful for the discrimination of formation layers while drilling and which takes place at the point of drilling.

Preferably the continuous measurements are taken whilst drilling is in progress.

The pressure at the drill bit may also be continuously monitored and the values additionally used as an input to calculate the MSE.

The weight on bit (WOB) (also at the drill bit) may also be continuously monitored and the values additionally used to calculate the MSE. wherein the continuous measurements are taken whilst drilling is in progress, at a measuring rate, which is one measurement being taken after a given distance travelled by the drill bit, wherein the measuring rate is preferably within the range of one measurement per 1 cm to one measurement per 100 cm of distance travelled.

The continuous measurements taken whilst drilling is in progress at the measurement rate which may be in the range of one measurement per 1 cm to one measurement per 10 cm of distance travelled.

According to the present invention, there is also provided an apparatus for drilling a well which includes a drill bit driven to rotate and arranged at the end of a length of drill tubing, including a motor to rotate the drill bit and steering means to steer the drill bit, and including torque measuring means are to measure the torque applied to the drill bit continuously and processing means are provided to calculate values for the mechanical specific energy (MSE) and measured depth data over time whilst drilling, characterised in the processing means including comparison means which is configured to compare the measured data with known data to determine the nature of the formation being drilled compared to known types of formation, and which processing means is configured to indicate a change from a first formation type to a second formation type, thus indicating the presence of a formation boundary, and to determine the accurate depth of the formation boundary, when the drill bit is adjacent to or just past the formation boundary.

The apparatus may include high speed transmission means for transmitting the measured values from the drill bit to a directional drilling control means.

Preferably, the motor is a hydraulic motor, and may be either a positive displacement type mud motor or a turbine type mud motor. The motor may be an electric motor.

Preferably, the apparatus includes a sensing element which senses the torque continuously and continuously transmits the torque values to the control means whilst drilling is in progress.

The apparatus may also include a sensing element which senses the weight applied to the bit, known as the weight-on-bit or WOB continuously and continuously transmits the WOB values to the control means whilst drilling is in progress.

The apparatus may also include a sensing element which senses the pressure at the drill, continuously and continuously transmits the drill bit pressure values to the control means whilst drilling is in progress.

Preferably the control means includes means of processing the torque, WOB or pressure values or a combination thereof, to create a representation of the formation porosity at the point of the drill bit as the well progresses, which is used as an aid to further navigation of the drilling.

Preferably the apparatus includes a depth sensor to measure the depth of the drill bit which depth sensor may be based on the reel or injector determining the length of tubing paid out and preferably includes a smoothing algorithm applied to the injector or reel derived depth signal.

Embodiment of the present invention will now be described in more detail, with reference to the attached drawings in which.

Figure 1:
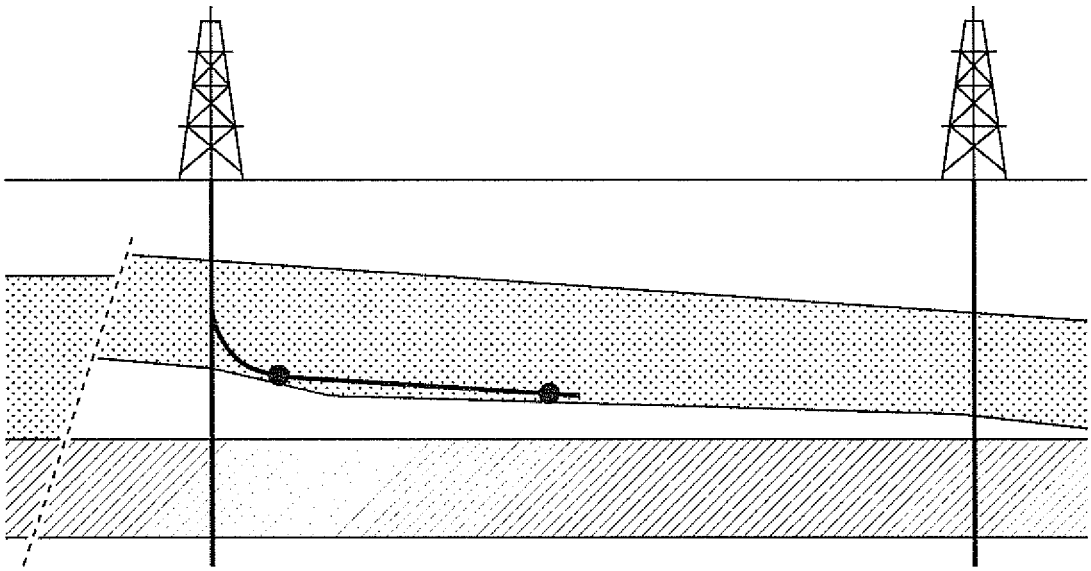
FIG. 1 shows a side elevation of an oil field formation.
Figure 2:
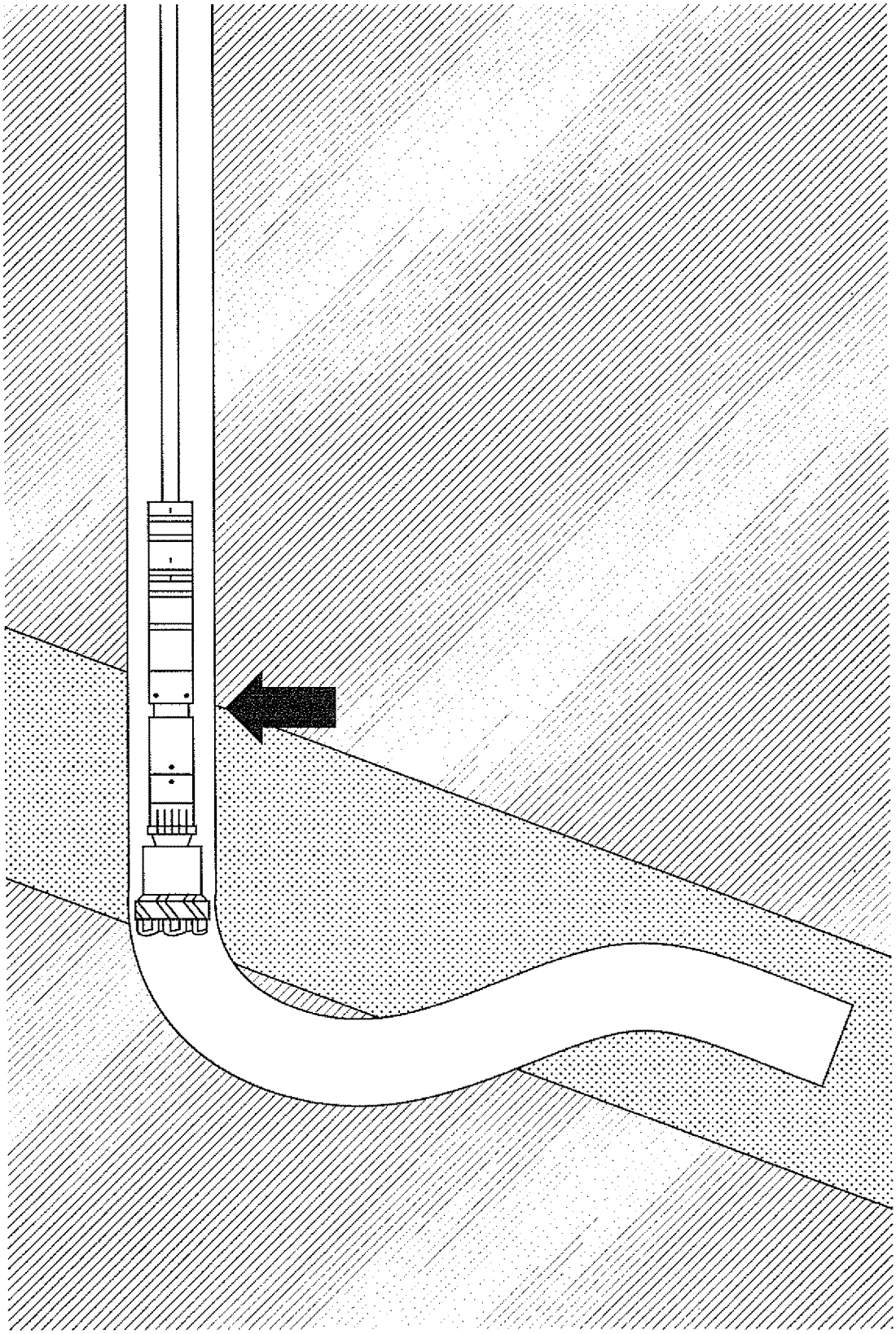
FIG. 2 shows a known directional drilling bottom hole assembly (BHA), drilling a hole whose target lies in a relatively thin formation.

Referring to FIGS. 1 and 2 the problem of accurately locating and drilling in non-linear formations is shown. Referring to FIG. 1 the presence of the formation boundary based on measurements in a vertical bore hole can result in the subsequent directionally drilled lateral hole completely missing the formation due to the non-linearity of the formation boundary.

FIG. 2 shows a known method of overcoming this problem by the use of sensors on the bottom hole assembly as shown by the arrow. The sensors are, by necessity, many tens of feet behind the drill bit. A consequence of this is that thinner formations may be penetrated and exited by the bit before they are detectable by the sensor.

Although the directional drilling functionality may be used to steer the hole back into the formation of interest, this is at a cost of operational time and equipment life used drilling a length of borehole in a non-productive formation.

Figure 3:
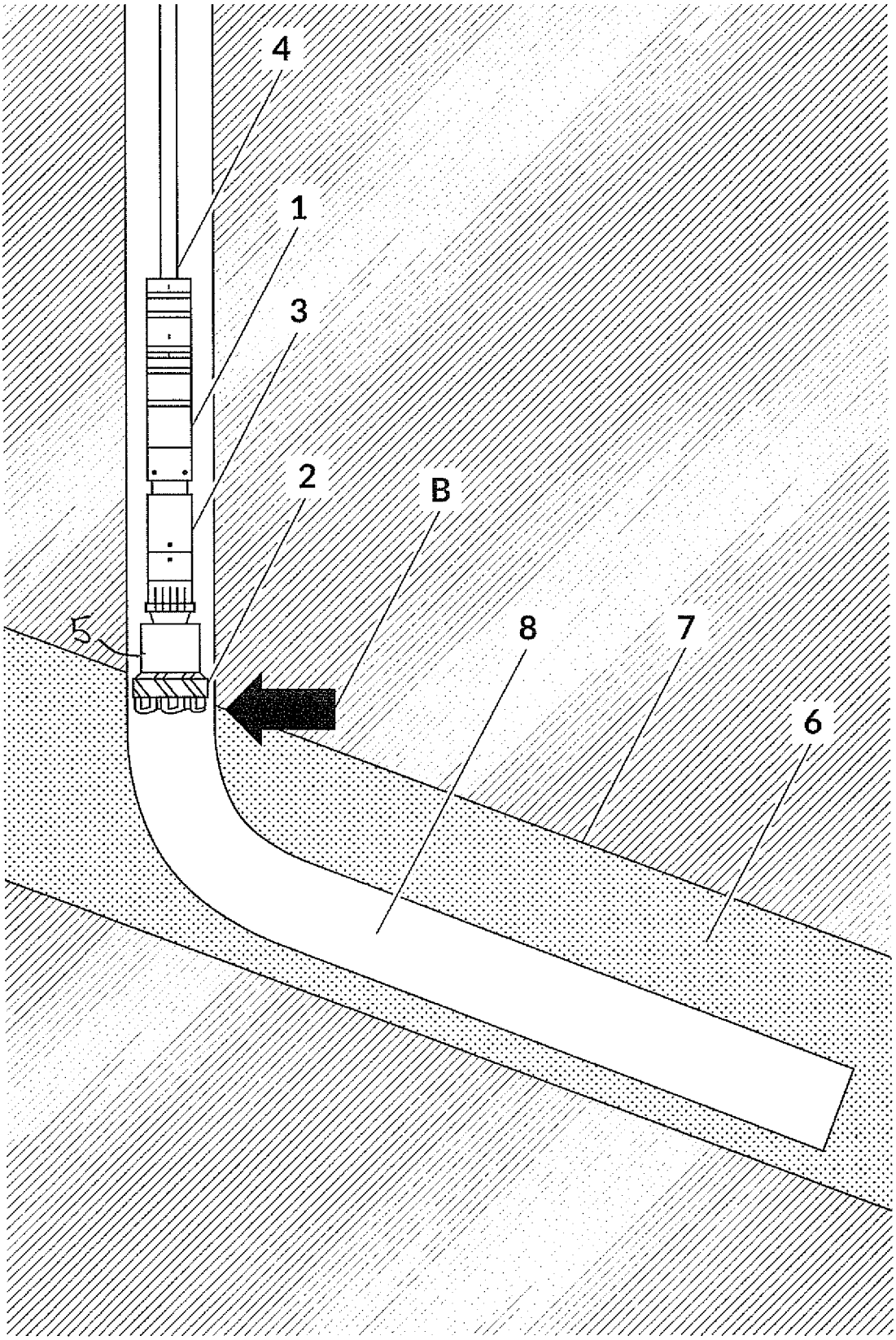
FIG. 3 shows a directional drilling hole drilled following the method, and using the apparatus, of the invention.

FIG. 3 shows how use of the method and apparatus disclosed herein results in a more optimally placed wellbore, with no time spent drilling the non-productive formation.

The method and apparatus disclosed herein may be used, in isolation or in conjunction with existing sensor technologies, to overcome these drawbacks and to provide high resolution formation discrimination at the location of the drill bit.

The invention uses the concept of Mechanical Specific Energy. MSE is a measure of the work done in drilling a length of hole. Different geological formation layers have measurably different MSE values. Data acquired during drilling operations indicates that changes in MSE as the hole progresses are strongly indicative of corresponding changes in formation porosity. If MSE is measured continuously as the hole progresses then the crossing of a formation boundary will be revealed as a step change in MSE. Comparing a plot of MSE vs the true vertical depth (TVD) with a previously established lithological sequence, enables the position of the bit in relation to local geological features to be determined.

By means of the invention and the MSE and measured depth data are continually calculated over time whilst drilling by data processing means. The data processing means includes comparison means to determine the nature of the formation being drilled compared to known types of formation, and to indicate the presence of a formation boundary, and to thus determine the accurate depth of the formation boundary, at the moment in time when the drill bit is adjacent to or just past the formation boundary.

For rotary drilling, MSE is a formula with two elements, a weight element and a torque element.

An expression for MSE is:

$$E = \frac{W}{A} + \frac{120\pi TN}{PA}$$

Where:

E=Mechanical Specific Energy

W=Weight on Bit,

A=cross sectional area of the borehole,

N=bit speed, RPM

T=torque

P=Rate of Penetration m/hr

While the expression itself is useful on its own, it has been found to be particularly useful to provide the generation of a real time and sufficient accurate flow of data values for the MSE and to use this data for formation discrimination.

Directly measured weight on bit is difficult to determine during drilling. The weight on bit is instead inferred from hook load at surface, and corrections are made for the buoyant weight of the drill pipe and the frictional interaction between the drill pipe and the borehole wall.

Similarly, directly measured drill bit torque is rarely available. Rotary table torque has to be corrected for friction between the pipe and the borehole wall. The error inherent in these corrections may be large enough to make the small changes in MSE that characterises changes in the formation being drilled difficult to detect. In cases where a downhole mud motor is used, bit torque is derived from motor differential pressure, but to obtain the required accuracy measurements of pressure near the motor are made and used to eliminate the error induced by pressure drop in the drill pipe.

In addition conventional drilling telemetry systems are slow. Synthetic porosity has the potential to offer inch level formation discrimination. For this to be possible, a minimum of two (and preferably more) complete sets of data need to be available on the scale of the resolution required.

For example, drilling at 6 m/hr, and requiring inch resolution. 6 m/hr equates to 2.5 cm every 15 seconds. A complete set of data typically consists of internal and external pressure, WOB and Torque. If each of these is expressed as a 12 data bit quantity, then each data set can be expressed in 48 data bits. 2 data sets would be 96 data bits. Given that typical mud pulse data rates are in the range 1.5 to 4 data bits per second, it can readily be seen that providing high rate data for synthetic porosity alone would saturate the telemetry channel. Considering also that the same channel is required to transmit operationally critical data such as steering data, and commands, it is clear that in a conventional mud pulse system there is insufficient bandwidth available to support synthetic porosity. Throughout this disclosure, references to high speed telemetry are references to telemetry systems whose speed is sufficient to overcome these limitations.

Referring to FIG. 3, in a preferred embodiment, there is provided an apparatus for directional drilling 1 which includes a drill bit 2 driven by a motor 3 and arranged at the end of a length of coiled tubing 4. Torque measuring means 5 are provided to measure the torque applied to the drill bit 2 by the motor 3 continuously and a processing means to calculate a value for the mechanical specific energy (MSE) in real time to indicate the presence of a formation boundary 7 of a formation 6, so that the direction of the drill bit can be changed to continue drilling within the formation to form the desired formation hole 8. The directional drilling apparatus 1, is also commonly referred to as a drilling bottom hole assembly (BHA) 1.

In the drilling BHA 1 the torque sensor 5 is arranged so that it is sensitive only to torque applied at the drill bit.

This drilling BHA 1 also has a weight on bit (WOB) sensor, which is sensitive only to weight applied to the drill bit, which continuously provides a real time value for the weight on the drill bit. In addition pressure sensors are provided to enable the pressure drop across the drilling motor to be measured.

Furthermore a speed sensor measures the rotational speed of the drilling motor. All of the sensors may be electrical, electronic or based on other physical properties.

The drilling BHA 1 also incorporates a telemetry system such that the measurements from the sensors above may be transmitted to a surface processing element sufficiently fast for the data to be useful in calculating a real time value for the MSE and thus the early indication of a formation boundary as described above.

Figure 6:
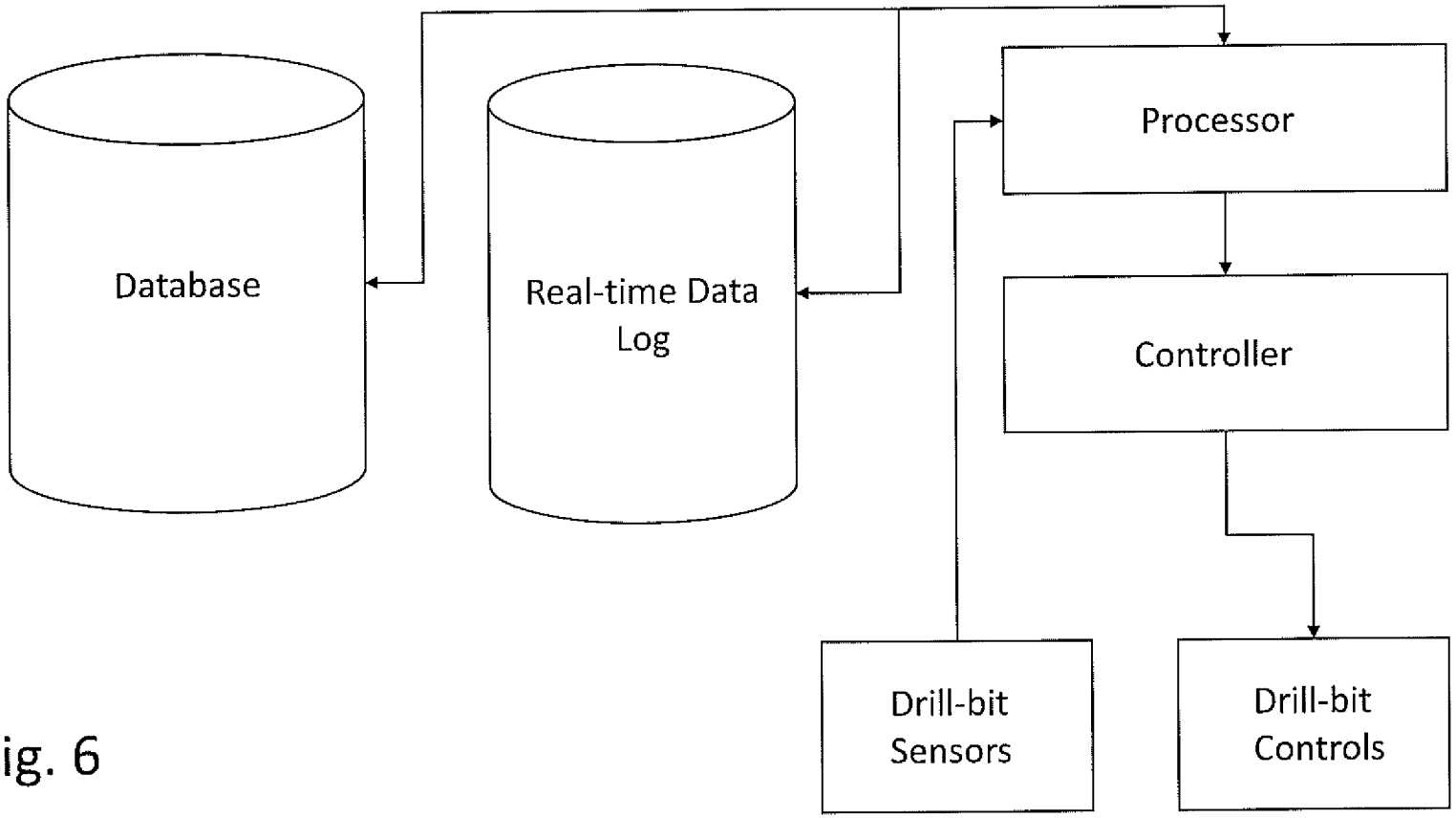
FIG. 6 shows a layout diagram of the operating elements of a further embodiment of the invention.

FIG. 6. shows an embodiment of a closed loop configuration showing the schematic layout of the data processing elements of the apparatus including the processer which processes the data, and which is connected to a database or library of historical formation data, as well as to a real-time log. The database and real-time log are collectively referred to as the comparison means, and by means of the processer the formation characteristics are determined to enable the boundary between a first formation and a second formation to be determine and the depth of this formation boundary layer to be determined. By modelling it is also possible to determine other characteristics of the formation boundary layer and of the second formation, such as the profile and inclination, and as the drilling progresses the modelling continues to determine the depth and three dimensional shape of the second formation.

The database is created and maintained by logging historical data and ascribing formation type descriptors that are characteristic of the formation and which correspond to the received and calculated MSE data.

The data log can include data such as time, depth, drill speed and direction vectors, torque, MSE, WOB, and a resultant formation characterisation. Initial characterisations can be entered and defined manually, and refined on an on-going basis.

The apparatus includes high speed transmission means in the form of a cable inside the coiled tubing 4 for transmitting the measured values from the BHA to the processor.

In addition in one embodiment the processor is connected to the control means to enable the automatic change of direction of the drill bit to direct the drill be in the optimum direction with in the second formation.

The control means may be remote from the BHA, such as at the surface and the high speed transmission means may be copper or fibre optic cable. In an alternative embodiment an operator at the surface can monitor the MSE data and the indication of a formation boundary layer in real time, and make a decision to change the direction of drilling accordingly.

Alternatively the directional drilling control means may be located in the BHA and the direction of drilling changed automatically based on the MSE data.

The motor is a hydraulic motor in this embodiment, but may alternatively be an electric motor or a turbine type mud motor.

The performance of the data processing task may take place by processing means at the BHA and enabling only transmission of the results to the surface. In this embodiment where a mud motor is used the mud motor rotational speed is derived from the measured flow rate and pressure of the drilling fluid. In other embodiments with different motor types, direct measurement of rotary speed may be included.

The control means can be incorporated in a surface operating interface, which may well embody other functionalities associated with drilling, and can perform computations on the data from the BHA, and display the computed synthetic porosity as a log line against depth.

Drilling an oil well is a non-continuous process. It is better described as a succession of short periods of continuous drilling, interrupted by periods in which other operational necessities are accomplished. Depending on the drilling technology employed, these operational necessities may be wiper trips, pipe joints, bit trips or motor trips. For optimal fidelity of synthetic porosity it is important that the computation is done only using data sampled during the continuous drilling periods.

Thus the method of the invention is to use the resultant MSE against the measured depth relationship to detect characteristic changes in the formation being drilled and the point at which these changes have occurred. The method steps are as follows:

h) measurements are made of the torque applied to the drill bit by the rotating means continuously,
i) values for the mechanical specific energy (MSE) are calculated during drilling,
j) measuring depth data over time whilst drilling,
k) comparison of the logged real time data with known values derived from historical formation data,
l) determining the type of the formation being drilled compared to known types of formation,
m) recording a change from a first formation type to a second formation type, thus indicating the presence of a formation boundary,
n) determining the accurate depth of the formation boundary, at the moment in time when the drill be is at or just past the formation boundary.

Figure 5:
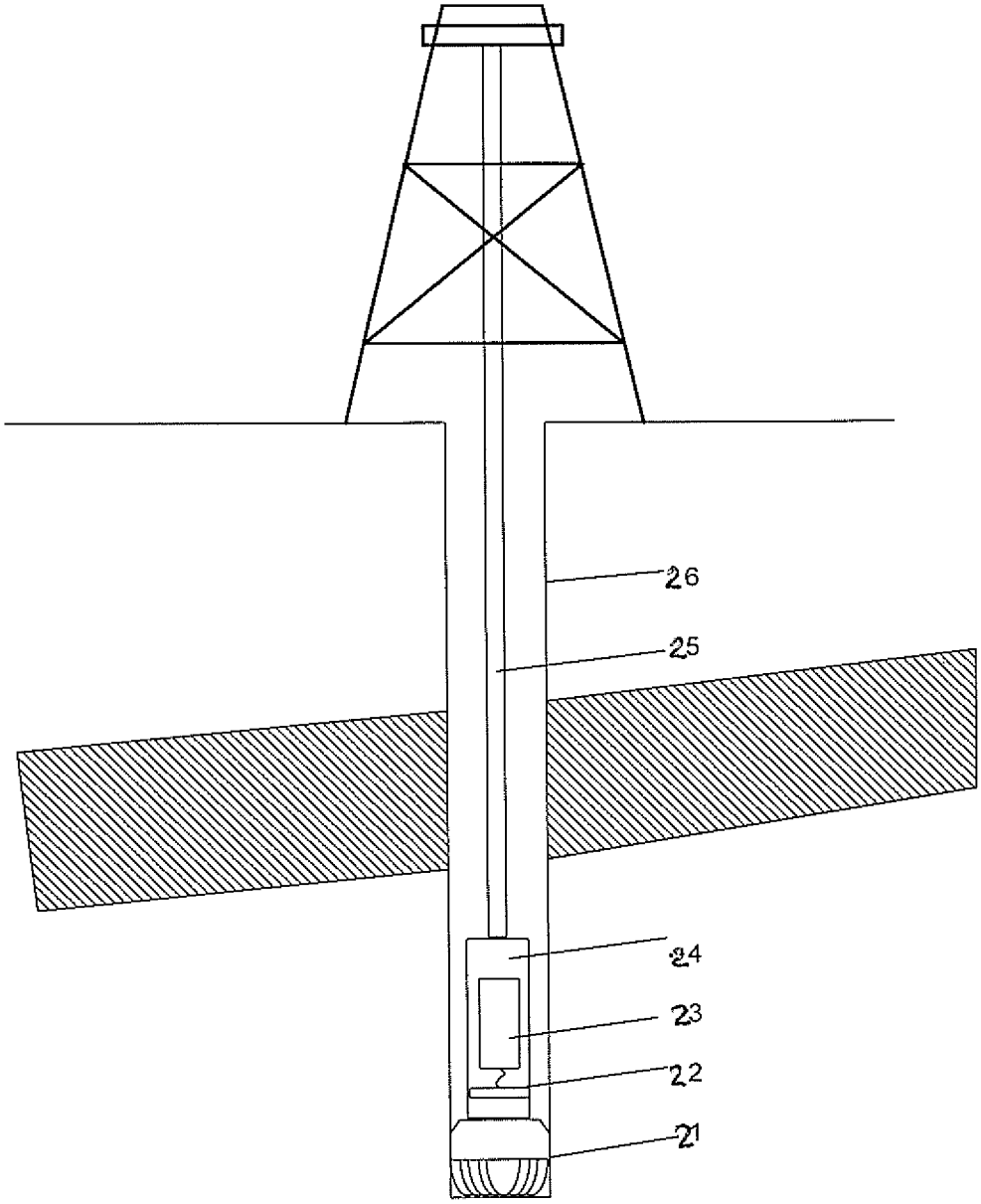
FIG. 5 shows an alternative embodiment of the invention using joined drill pipe.

Referring now to FIG. 5 an alternative embodiment is shown in which the invention is applied to drilling with more conventional sectioned drill pipe rather than with continuous coiled tubing.

Conventional drilling involves using a drilling rig at the earth's surface to rotate a length of drill pipe 25, at the lower end of which is a cutting bit 21. As the cutting bit is rotated, the borehole 26 progresses. It is known to position an instrumentation assembly 24 between the lower end of the drill pipe 25 and the bit 21. This instrumentation assembly comprises sensors for the purpose of monitoring the drilling operation. In this embodiment the instrumentation assembly includes a torque sensing element 22 and a processing element 23, and also includes a means of transmitting sensor data to surface and/or storing it in a local memory.

The torque sensing element of these is an array of strain gauges mounted on a pressure compensated assembly.

In certain circumstances, for positive displacement motors, depending on how much heavy iron is between the torque sensor and the bit, a value for the torque can also be determined by taking measurements of pressure drop across the motor.

Thus the steps of the method of the invention in this embodiment are measuring torque and weight on bit at the instrumentation assembly, combining it with rotary speed and Rate of Penetration, and calculating MSE sufficiently frequently for a high level of resolution.

The frequency of measurement and calculation is sufficient to achieve a resolution down to 2-3 cm (or approximately one inch).

The continuous measurements are taken whilst drilling is in progress at a measuring rate, being one measurement being taken after a given distance travelled by the drill bit, wherein the measuring rate is within the range of one measurement per 1 cm to one measurement per 100 cm of distance travelled at the rate of one measurement taken at every between per 1 cm to 100 cm.

For greater accuracy the continuous measurements may be taken whilst drilling is in progress at the rate of one measurement taken at every between per 1 cm to 10 cm.

It is possible to simply log the torque and WOB data to memory on the instrumentation assembly, with a time stamp, and combine it with depth data after the completion of drilling, when the logged data is downloaded with the tool at surface.

Similarly, the BHA may be equipped with a means of determining change of hole depth as drilling progresses, in which case combination with continuous depth recorded at surface is not required.

Clearly this approach loses the beneficial aspect of presenting 'At drill bit formation evaluation' in real time, but this ability to produce this high resolution measurement whilst drilling, without the expense of a conventional formation evaluation sub is advantageous, for example in designing fracture programs.

In the case of coiled tubing drilling, the dynamic relationship between the drill bit's progression at the end of the hole and the feeding of coiled tubing from the reel at surface often exhibits 'stick-slip' behavior. (This linear stick-slip is not the same phenomenon as the torsional stick slip encountered with drill pipe). Linear stick-slip is of consequence in the computation of MSE, and hence the predicted synthetic porosity, because hole depth, which cannot be directly measured, is inferred from the length of coiled tubing fed in to the hole.

Stick slip results in the recorded depth signal having step artefacts. If MSE is calculated across a step (between points A and C in FIG. 4), an artificially low value will be returned, whereas if MSE is calculated along a step, an artificially high value will be returned. The error becomes increasingly pronounced as the depth resolution of the MSE calculation comes close to the length of coiled tubing fed in to the hole during each slip of the stick slip cycle.

Figure 4:
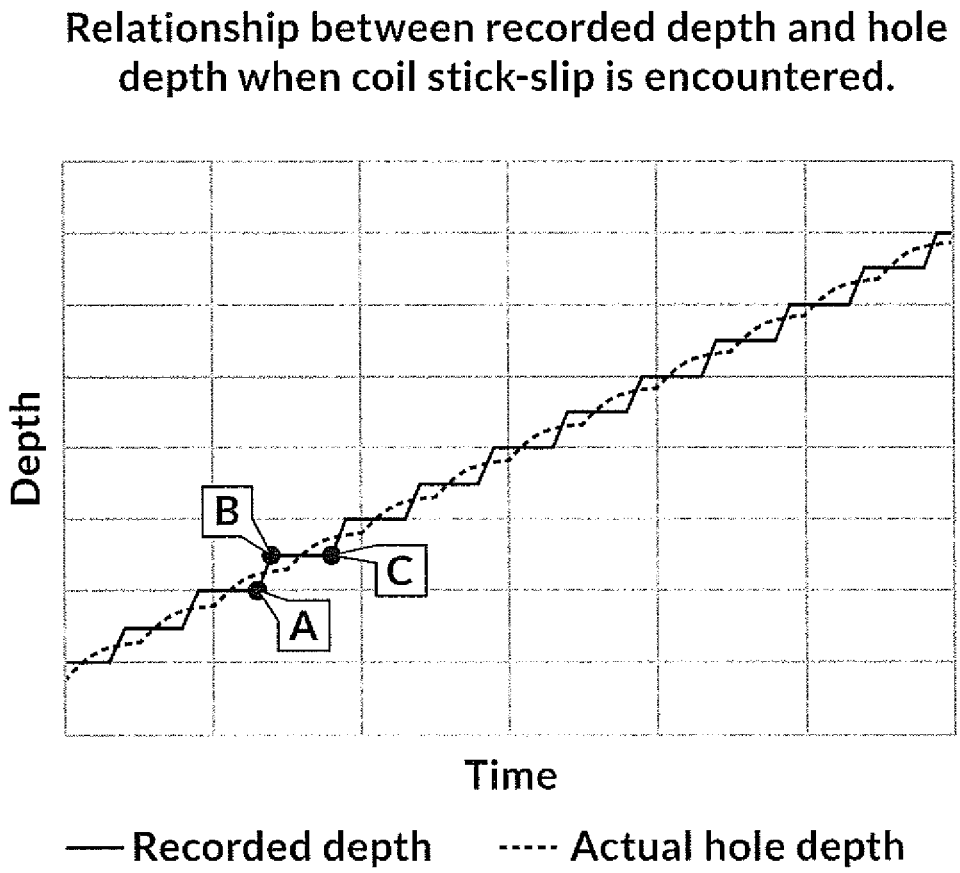
FIG. 4 shows a graph of recorded depth using reel based depth measurement versus actual depth.

Accuracy of the MSE calculation is improved by applying a smoothing algorithm to the injector or reel derived depth as shown in FIG. 4, which takes account of, and smooths out, the stick slip pattern observed in the injector or reel derived depth data. Each coiled tubing installation will have a unique stick slip pattern. Thus by modelling the stick slip pattern of a particular installation during unreeling whist drilling, a smoothing algorithm is derived, which is then used to smooth out the stick slip pattern as the drilling progresses. Historical stick slip data can be used as a starting point for each new coiled tubing installation.

The invention claimed is:

1. An apparatus for directional drilling a well, comprising:

a drill bit arranged at an end of a length of drill tubing fed from a reel including a coil of said drill tubing;

a motor arranged at the end of the length of the drill tubing and configured to rotate the drill bit;

a steering apparatus configured to steer the drill bit so that a direction of the drill bit can be changed to continue drilling within a formation being drilled to form a desired formation hole, said steering apparatus arranged at the end of the drill tubing;

a torque sensor configured to continuously measure torque applied to the drill bit by the motor during drilling while drilling is in progress;

a processor operative during drilling and configured to:

calculate values for a mechanical specific energy (MSE) and measured depth data continually over time while drilling, compare the measured depth data with known data to determine the nature of said formation being drilled compared to known types of formation, indicate a change from a first formation type to a second formation type, thus indicating the presence of a formation boundary, and determine an accurate depth of the formation boundary at a moment in time when the drill bit is at or just past the formation boundary; and a drilling direction controller configured to change the direction of the drill bit in real-time during drilling on detection of the formation boundary by the processor to enable continuous drilling within the formation, without stopping, when the drill bit is adjacent to or just past the formation boundary;

wherein the processor is further configured to make corrections during drilling for a buoyant weight of the drill tubing and a frictional interaction between the drill tubing and a borehole wall to determine weight-on-bit (WOB) values continuously while drilling is in progress.

2. The apparatus according to claim 1, wherein the apparatus includes high speed transmission means for transmitting measured values from the drill bit to the drilling direction controller.

3. The apparatus according to claim 2, wherein the high speed transmission means includes copper or fibre optic cable.

4. The apparatus according to claim 2, wherein the processor is part of a surface processing element remote from the end of the length of drill tubing fed from the reel.

5. The apparatus according to claim 1, wherein the torque sensor senses the torque applied to the drill bit continuously while drilling is in progress and continuously transmits torque values to the processor whilst drilling is in progress.

6. The apparatus for directional drilling according to claim 5, wherein the torque applied to the drill bit by the motor during drilling is derived from a motor differential pressure.

7. The apparatus for directional drilling according to claim 5, wherein the apparatus also includes a sensing element which senses the weight applied to the bit, known as the weight-on-bit or WOB continuously during drilling while drilling progresses and continuously transmits WOB values to the processor in real time whilst drilling is in progress.

8. The apparatus for directional drilling according to claim 1, wherein the apparatus includes a depth sensor to measure a depth of the drill bit to provide said measured depth data.

9. The apparatus for directional drilling according to claim 8, wherein the depth sensor derives a depth signal based on a length of said tubing paid out from said reel and includes a smoothing algorithm applied to said derived depth signal.

10. The apparatus for directional drilling according to claim 8, wherein the apparatus also includes a sensing element which senses a pressure at the drill bit, continuously and continuously transmits drill bit pressure values to the processor whilst drilling is in progress.

11. The apparatus for directional drilling according to claim 10, wherein the processor is configured to process the torque applied to the drill bit, WOB or pressure values or a combination thereof during drilling while drilling is in progress, to create a representation of a formation porosity at a point of the drill bit as the well progresses, which is used as an aid to further navigation of the continuous drilling.

12. The apparatus according to claim 1, wherein the motor is a hydraulic motor.

* * * * *